US009111661B2

(12) United States Patent
Saito et al.

(10) Patent No.: US 9,111,661 B2
(45) Date of Patent: Aug. 18, 2015

(54) CABLE FOR HIGH-VOLTAGE ELECTRONIC DEVICES

(75) Inventors: Mariko Saito, Minato-ku (JP); Masahiro Minowa, Minato-ku (JP); Masamitsu Yamaguchi, Minato-ku (JP); Kazuaki Noguti, Minato-ku (JP)

(73) Assignee: SWCC SHOWA CABLE SYSTEMS CO., LTD., Tokyo (JP)

( * ) Notice: Subject to any disclaimer, the term of this patent is extended or adjusted under 35 U.S.C. 154(b) by 226 days.

(21) Appl. No.: 13/805,161

(22) PCT Filed: Apr. 18, 2011

(86) PCT No.: PCT/JP2011/002250

§ 371 (c)(1),
(2), (4) Date: Dec. 18, 2012

(87) PCT Pub. No.: WO2011/158420

PCT Pub. Date: Dec. 22, 2011

(65) Prior Publication Data

US 2013/0092416 A1 Apr. 18, 2013

(30) Foreign Application Priority Data

Jun. 18, 2010 (JP) ..... 2010-139743

(51) Int. Cl.
*H01B 9/02* (2006.01)
*H01B 3/28* (2006.01)
*H01B 3/44* (2006.01)

(52) U.S. Cl.
CPC ..... *H01B 9/027* (2013.01); *H01B 3/28* (2013.01); *H01B 3/441* (2013.01)

(58) Field of Classification Search
CPC ..... H01B 7/184; H01B 7/185; H01B 1/24; H01B 7/2825; H01B 9/027; H01B 11/206; H01B 3/004; H01B 7/2813; H01B 11/10; H01B 13/14; H01B 1/22; H01B 3/30; H01B 3/46; H01B 7/0861; H01B 3/44
USPC ..... 174/15.1–15.3, 21 R–29, 32–36, 174/74 R–84 S, 102 R–124 GC, 126.1–133 B, 174/21 R–29
See application file for complete search history.

(56) References Cited

U.S. PATENT DOCUMENTS

| | | | | |
|---|---|---|---|---|
| 4,684,766 | A * | 8/1987 | Tanaka et al. | 174/115 |
| 6,043,309 | A | 3/2000 | Nakamura et al. | |
| 6,088,792 | A * | 7/2000 | Slegel et al. | 712/228 |
| 7,872,198 | B2 * | 1/2011 | Lee et al. | 174/102 SC |
| 2011/0209895 | A1 | 9/2011 | Saito et al. | |

FOREIGN PATENT DOCUMENTS

| | | |
|---|---|---|
| JP | 3 214509 | 9/1991 |
| JP | 10 219114 | 8/1998 |

(Continued)

OTHER PUBLICATIONS

International Search Report Issued Jul. 12, 2011 in PCT/JP11/02250 Filed Apr. 18, 2011.

*Primary Examiner* — Jenny L Wagner
*Assistant Examiner* — Ahmad D Barnes
(74) *Attorney, Agent, or Firm* — Oblon, McClelland, Maier & Neustadt, L.L.P.

(57) ABSTRACT

A cable for high-voltage electronic devices including an inner semiconductive layer, a high-voltage insulator, an outer semiconductive layer, a shielding layer, and a sheath which are provided on an outer periphery of a cable core part in the order mentioned, wherein the high-voltage insulator is made of an insulating composition whose temperature dependence parameter $D_R$ found by the following expression is 1.0 or less: $D_R = \log R_{23°C.} - \log R_{90°C.}$ (where $R_{23°C.}$ is volume resistivity (Ω·cm) at 23° C. and $R_{90°C.}$ is volume resistivity (Ω·cm) at 90° C.). The cable for high-voltage electronic devices is small in diameter and has an excellent withstand voltage characteristic.

9 Claims, 1 Drawing Sheet

(56) References Cited

FOREIGN PATENT DOCUMENTS

| | | |
|---|---|---|
| JP | 2000 133048 | 5/2000 |
| JP | 2001 256837 | 9/2001 |
| JP | 2002 245866 | 8/2002 |
| JP | 2008 266371 | 11/2008 |
| WO | 2010 090034 | 8/2010 |

* cited by examiner

CABLE FOR HIGH-VOLTAGE ELECTRONIC DEVICES

TECHNICAL FIELD

The present invention relates to a cable used for high-voltage electronic devices such as CT (computerized tomography) devices for medical use and X-ray devices.

BACKGROUND ART

Cables for high-voltage electronic devices such as CT devices for medical use and X-ray devices to which a high DC voltage is applied are required (i) to be small in outside diameter and light-weighted, (ii) to have good flexibility and be resistant against movement and bending, (iii) to be small in capacitance and be capable of following the repeated application of high-voltages, and (iv) to have heat resistance high enough to endure the heat generation of an X-ray vacuum tube part.

As such a cable for high-voltage electronic devices (for example, an X-ray cable), there has been known one in which two low-voltage cable cores and one bare conductor or two are twisted together, an inner semiconductive layer is provided thereon, and a high-voltage insulator, an outer semiconductive layer, a shielding layer, and a sheath are further provided thereon in the order mentioned. As the high-voltage insulator, used is a composition with its base being EP rubber (ethylene propylene rubber) that is light-weighted and flexible and has relatively good electric characteristics (see, for example, Reference 1).

In recent years, EP rubber compositions having a low dielectric constant (about 2.3) have been put into practical use and cables for high-voltage electronic devices using this as a material of the high-voltage insulator and having a smaller diameter and smaller capacitance have been developed.

These EP rubber compositions, however, have a problem that their withstand voltage characteristic is not high enough because their volume resistivity greatly lowers as temperature increases due to high temperature dependence of the volume resistivity. Specifically, in the aforesaid cable, when the temperature of the conductor increases due to energization, the temperature of the high-voltage insulator nearby increases, but because the EP rubber composition whose electric resistivity has high temperature dependence is used as the high-voltage insulator, the volume resistivity of the high-voltage insulator near the conductor lowers. As a result, an electric field concentrates near an interface between the outer semiconductive layer and the high-voltage insulator, which tends to cause dielectric breakdown. This phenomenon also occurs in an AC power cable, but causes a great problem especially in a DC power cable such as a cable for high-voltage electronic devices. This phenomenon causes a still greater problem in a cable realizing a diameter reduction by the use of the low-dielectric constant EP rubber composition because its high-voltage insulator is thin. Therefore, there is a demand for an insulating material whose volume resistivity has low temperature dependence.

RELEVANT REFERENCES

Patent Reference

Reference 1: JP-A 2002-245866 (KOKAI)

SUMMARY OF THE INVENTION

Problem to be Solved by the Invention

It is an object of the present invention to provide a cable for high-voltage electronic devices that is small in diameter yet has an excellent withstand voltage characteristic owing to the use of an insulating material whose volume resistivity has low temperature dependence.

Means for Solving the Problems

A cable for high-voltage electronic devices of one embodiment of the present invention includes an inner semiconductive layer, a high-voltage insulator, an outer semiconductive layer, a shielding layer, and a sheath which are provided on an outer periphery of a cable core part in the order mentioned, wherein the high voltage insulator is made of an insulating composition whose temperature dependence parameter $D_R$ found by the following expression is 1.0 or less:

$$D_R = \log R_{23^\circ C.} - \log R_{90^\circ C.},$$

(where, $R_{23^\circ C.}$ is volume resistivity (Ω·cm) at 23° C. and $R_{90^\circ C.}$ is volume resistivity (Ω·cm) at 90° C.).

In another embodiment of the present invention, $R_{23^\circ C.}$ is not less than $1.0\times10^{14}$ Ω·cm nor more than $1.0\times10^{18}$ Ω·cm.

In another embodiment of the present invention, the high-voltage insulator is made of an insulating composition containing not less than 0.5 part by mass nor more than 10 parts by mass of dry silica relative to 100 parts by mass of an olefin-based polymer, a specific surface area of the dry silica being not less than 150 $m^2/g$ nor more than 250 $m^2/g$.

In another embodiment of the present invention, an average primary-particle diameter of the dry silica is not less than 7 nm nor more than 20 nm.

In another embodiment of the present invention, pH of a 4% aqueous dispersion liquid of the dry silica is not less than 4 nor more than 4.5.

In another embodiment of the present invention, the dry silica is fumed silica.

In another embodiment of the present invention, the olefin-based polymer comprises ethylene propylene rubber.

In another embodiment of the present invention, the olefin-based polymer is crosslinked.

Another embodiment of the present invention is a small-diameter cable for high-voltage electronic devices whose outside diameter is not less than 10 mm nor more than 70 mm.

Effect of the Invention

According to one embodiment of the present invention, it is possible to obtain a cable for high-voltage electronic devices that is small in diameter yet has an excellent withstand voltage characteristic.

DETAILED DESCRIPTION

Figure 1:
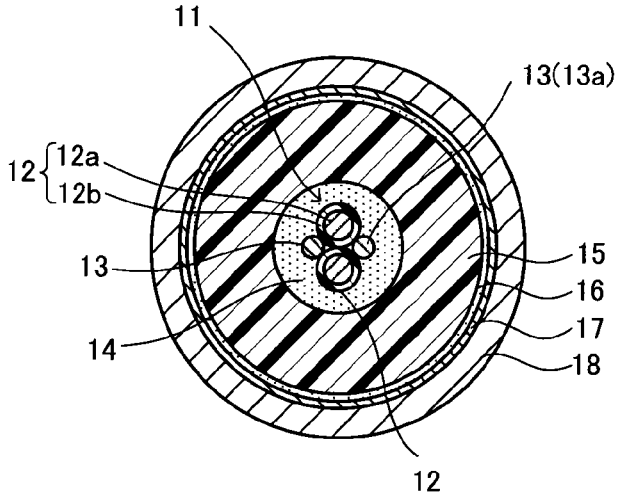
[FIG. 1] is a horizontal sectional view showing one embodiment of a cable for high-voltage electronic devices of the present invention.

FIG. 1 is a horizontal sectional view showing a cable for high-voltage electronic devices according to one embodiment of the present invention.

In FIG. 1, 11 denotes a cable core part. The cable core part 11 is composed of a braid of two low-voltage cable cores 12 and two high-voltage cable cores 13 whose diameter is equal to or smaller than an outside diameter of the low-voltage cable cores 12. The low-voltage cable cores 12 each include: a conductor 12*a* with a 1.8 $mm^2$ sectional area which is composed of 19 collectively-stranded tin-plated annealed copper wires each having a diameter of, for example, 0.35 mm; and an insulator 12*b* provided on the conductor 12*a*, made of fluorocarbon resin such as, for example, polytetrafluoroethylene, and having a thickness of, for example, 0.25 mm. The high-voltage cable cores 13 each include a bare conductor 13*a* with a 1.25 $mm^2$ sectional area which is composed of 50 collectively-stranded tin-plated annealed copper wires each having a diameter of, for example, 0.18 mm. In some case, a semiconductive coating may be provided on the bare conductor 13*a*.

On an outer periphery of the cable core part 11, an inner semiconductive layer 14, a high-voltage insulator 15, and an outer semiconductive layer 16 are provided in the order mentioned. The inner semiconductive layer 14 and the outer semiconductive layer 16 are each formed in such a manner that a semiconductive tape made of, for example, a nylon base material, a polyester base material, or the like is wound around and/or semiconductive rubber plastic such as semiconductive ethylene propylene rubber is applied by extrusion.

The high-voltage insulator 15 is made of an insulating composition containing 0.5 to 10 parts by mass of dry silica relative to 100 parts by mass of olefin-based polymer, a specific surface area of the dry silica as measured by a nitrogen gas adsorption method (BET method) being not less than 150 $m^2/g$ nor more than 250 $m^2/g$.

Examples of the olefin-based polymer are: ethylene propylene rubber such as ethylene propylene copolymer (EPM) and ethylene propylene diene copolymer (EPDM); polyethylene such as low-density polyethylene (LDPE), mid-density polyethylene (MDPE), high-density polyethylene (HDPE), very low-density polyethylene (VLDPE), and linear low-density polyethylene (LLDPE); polypropylene (PP); ethylene-ethyl acrylate copolymer (EEA); ethylene-methyl acrylate copolymer (EMA); ethylene-ethyl methacrylate copolymer; ethylene-vinyl acetate (EVA); polyisobutylene; and so on. Also usable is one in which α-olefin such as propylene, butene, pentene, hexene, or octane, cyclic olefin is copolimerized with ethylene by a metallocene catalyst. These are used alone or in combination. Among all, ethylene propylene rubber such as ethylene propylene copolymer (EPM) or ethylene propylene diene copolymer (EPDM) is preferable as the olefin-based polymer. The other olefin-based polymers are preferably used as components co-used with ethylene propylene rubber. The olefin-based polymer is more preferably ethylene propylene rubber, and still more preferably ethylene propylene diene copolymer (EPDM). Concrete examples of the ethylene propylene diene copolymer (EPDM) are MITSUI EPT (trade name, manufactured by Mitsui Chemicals Inc.), ESPRENE EPDM (trade name, manufactured by Sumitomo Chemicals Co., Ltd.), and the like.

The dry silica used is not particularly limited, provided that its specific surface area (BET method) falls within the range not less than 150 $m^2/g$ nor more than 250 $m^2/g$. Compounding such dry silica makes it possible to obtain an insulating composition having an insulating property (especially volume resistivity) having low temperature dependence. The specific surface area (BET method) of the dry silica is preferably not less than 180 $m^2/g$ nor more than 220 $m^2/g$, more preferably not less than 190 $m^2/g$ nor more than 210 $m^2/g$, and still more preferably 200 $m^2/g$.

An average primary-particle diameter of the dry silica is preferably not less than 7 nm nor more than 20 nm, and more preferably not less than 10 nm nor more than 15 nm. When the average primary-particle diameter of the dry silica falls out of the above range, it is in the state of having difficulty in dispersing and desired volume resistivity cannot be obtained. The average primary-particle diameter of the dry silica is found through the measurement with a transmission electron microscope.

pH of a 4% aqueous dispersion liquid of the dry silica is preferably not less than 4 nor more than 4.5. When it falls out of the above range, crosslinking inhibition of the insulator occurs, which is liable to inhibit sufficient improvement in heat resistance and mechanical characteristics. Moreover, a desired insulator cannot be obtained, which is liable to make it impossible to obtain desired volume resistivity.

As described above, the compounding amount of the dry silica relative to 100 parts by mass of the olefin-based polymer is not less than 0.5 part by mass nor more than 10 parts by mass, and preferably not less than 1 part by mass nor more than 5 parts by mass. When the compounding amount is below the above range or over the above range, the temperature dependence of the volume resistivity of the composition becomes high, which is liable to inhibit the improvement in the withstand voltage characteristic of the cable.

Preferable concrete examples of the dry silica used in the present invention are AEROGEL 200 (trade name) made available by Japan Aerogel, which is fumed silica with its specific surface area (BET method) being 200 $m^2/g$, its average primary-particle diameter being 12 nm, and pH of its 4% aqueous dispersion liquid being 4.2 pH, and the like.

The high-voltage insulator 15 may be formed in such a manner that the dry silica is mixed with the aforesaid olefin-based polymer, whereby the insulating composition is prepared, and the obtained insulating composition is applied by extrusion on the inner semiconductive layer 14 or the obtained insulating composition is molded into a tape shape to be wound around the inner semiconductive layer 14. A method of mixing the olefin-based polymer and the dry silica is not particularly limited, and for example, a method of uniformly mixing and kneading them by using an ordinary kneader such as a Banbury mixer, a tumbler, a pressure kneader, a kneading extruder, a mixing roller is usable.

The insulating composition is preferably crosslinked with a polymer component after it is applied or molded in view of improving the heat resistance and mechanical characteristics. Examples of a crosslinking method are a chemical crosslinking method in which a crosslinking agent is added to the insulating composition in advance and the crosslinking is performed after the molding, an electronic-beam crosslinking method by the irradiation of electronic beams, and the like. Examples of the crosslinking agent used in the chemical crosslinking method are dicumyl peroxide, di-tert-butyl peroxide, 2,5-dimethyl-2,5-di-(tert-butyl peroxide)hexane, 2,5-dimethyl-2,5-di-(tert-butyl peroxide)hexyne-3, 1,3-bis(tert-butyl peroxyisopropyl benzene, 1,1-bis(tert-butyl peroxy)-3,3,5-trimethylcyclohexane, n-butyl-4,4-bis(tert-butyl peroxy) valerate, benzoyl oxide, 2,4-dichlorobenzoyl peroxide, tert-butyl peroxy benzoate, tert-butyl peroxy isopropyl carbonate, diacetyl peroxide, lauroyl peroxide, tert-butyl cumyl peroxide, and the like.

A degree of the crosslinking is preferably 50% or more in terms of gel fraction, and more preferably 65% or more. When the gel fraction is less than the above range, it is not possible to sufficiently improve the heat resistance and mechanical characteristics. This gel fraction is measured based on the test method for crosslinking degree specified in JIS C 3005.

When necessary, an inorganic filler other than dry silica, a processing aid, a crosslinking aid, a flame retardant, an antioxidant, an ultraviolet absorber, a coloring agent, a softening agent, a plasticizer, a lubricant, and other additives can be compounded besides the aforesaid components to the insulating composition within a range not inhibiting the effects of the present invention.

A temperature dependence parameter $D_R$ of the insulating composition found by the following expression (1) is 1.0 or less and preferably 0.5 or less. When the temperature dependence parameter $D_R$ is over the aforesaid range, it is not possible to sufficiently improve the withstand voltage characteristic of the cable:

$$D_R = \log R_{23^\circ C.} - \log R_{90^\circ C.} \quad (1),$$

(where $R_{23^\circ C.}$ is volume resistivity (Ω·cm) at 23° C. and $R_{90^\circ C.}$ is volume resistivity (Ω·cm) at 90° C. These voltage resistivities are measured by the double ring electrode method specified in JIS K 6271).

The volume resistivity $R_{23^\circ C.}$ at 23° C. is preferably not less than $1.0\times10^{14}$ Ω·cm nor more than $1.0\times10^{18}$ Ω·cm. When the volume resistivity $R_{23^\circ C.}$ is less than $1.0\times10^{14}$ Ω·cm, it is difficult to obtain a desired insulating function. Especially to obtain a small-diameter cable for high-voltage electronic devices whose outside diameter is not less than 10 mm or more than 70 mm, it is necessary to have the volume resistivity in the aforesaid range.

The insulating composition, when measured according to JIS K 6253, preferably has a type A durometer hardness of 90 or less. More preferably, it is 80 or less, and still more preferably 65 or less. When the type A durometer hardness is over 90, flexibility and handleability of the cable deteriorate.

The insulating composition preferably has a dielectric constant of 2.8 or less when measured by a high-voltage Schering bridge method under the conditions of 1 kV and a 50 Hz frequency. More preferably, it is 2.6 or less, and still more preferably 2.4 or less. When the dielectric constant is over 2.8, it is difficult to make the diameter of the cable small.

The inner semiconductive layer 14 has an outside diameter of, for example, 5.0 mm, and is coated with the high-voltage insulator 15 and the outer semiconductive layer 16 with, for example, a 3.0 mm thickness and a 0.2 mm thickness respectively.

On the outer semiconductive layer 15, a shielding layer 17 with a 0.3 mm thickness composed of, for example, a braid of tin-plated annealed copper wires is provided, and further thereon, a sheath 18 with a 1.0 mm thickness is provided by, for example, extrusion application of soft vinyl chloride resin.

In the above-described cable for high-voltage electronic devices, the high-voltage insulator 15 is made of the insulating composition containing a specific ratio of the dry silica relative to the olefin-based polymer, the specific surface area (BET method) of the dry silica being not less than 150 $m^2/g$ nor more than 250 $m^2/g$. This makes it possible to have a good withstand voltage characteristic even with a small diameter.

This is thought to be because owing to the use of the dry silica whose specific surface area (BET method) is not less than 150 $m^2/g$ nor more than 250 $m^2/g$, the temperature dependence of the voltage resistivity of the composition lowers and as a result, the withstand voltage of the cable improves.

Figure 2:
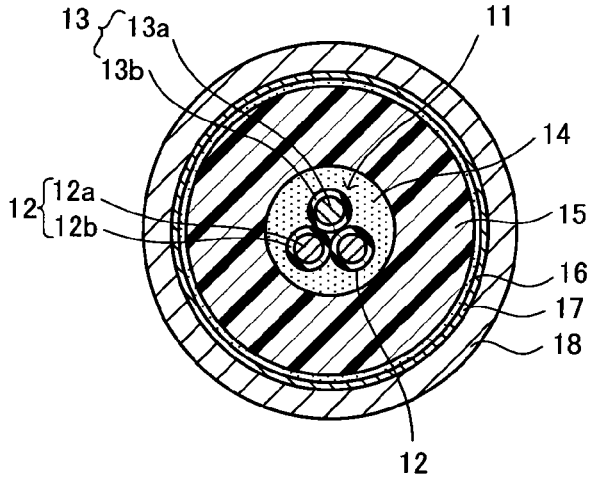
[FIG. 2] is a horizontal sectional view showing another embodiment of the cable for high-voltage electronic devices of the present invention.
Figure 3:
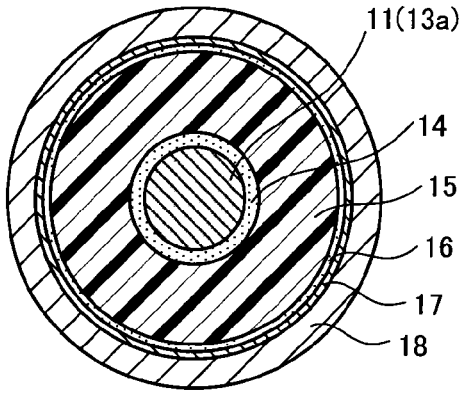
[FIG. 3] is a horizontal sectional view showing still another embodiment of the cable for high-voltage electronic devices of the present invention.

FIG. 2 and FIG. 3 are horizontal sectional views showing other embodiments of the cable for high-voltage electronic devices of the present invention respectively.

The cable for high-voltage electronic devices shown in FIG. 2 is structured similarly to the cable for high-voltage electronic devices shown in FIG. 1 except that the cable core part 11 includes two low-voltage cable cores 12 and one high-voltage cable core 13 whose diameter is equal to or smaller than an outside diameter of the low-voltage cable cores 12, which are twisted together. The low-voltage cable cores 12 each are composed of a conductor 12*a* with a 1.8 $mm^2$ sectional area which is composed of 19 collectively-stranded tin-plated annealed copper wires each with a diameter of, for example, 0.35 diameter, and an insulator 12*b* with a thickness of, for example, 0.25 mm provided on the conductor 12*a* and made of, for example, fluorocarbon resin such as polytetrafluoroethylene. Further, the high-voltage cable core 13 is composed of a bare conductor 13*a* with a 1.25 $mm^2$ sectional area composed of 50 collectively-stranded tin-plated annealed copper wires each with a diameter of, for example, 0.18 mm and a semiconductive coating 13*b* formed on the bare conductor 13*a* by, for example, winding of a semiconductive ethylene propylene rubber tape. The high-voltage cable core 13 may include only the bare conductor 13*a*.

The cable for high-voltage electronic devices shown in FIG. 3 is an example of a so-called single-core cable, and its cable core part 11 includes only a bare conductor 13*a*, and on the cable core part 11 (bare conductor 13*a*), an inner semiconductive layer 14, a high-voltage insulator 15, an outer semiconductive layer 16, a shielding layer 17, and a sheath 18 are provided in the order mentioned.

These cables for high-voltage electronic devices can also have a good withstand voltage characteristic even though they are small in diameter, similarly to the previously described embodiment.

The present invention is not limited to the above-described embodiments in their entirety, and any modification and change can be made within a range not departing from the spirit of the present invention.

EXAMPLES

The present invention will be described in more detail with reference to examples, but the present invention is not limited at all to these examples. Methods of measuring physical property values of the dry silica used in the following examples and comparative examples are as follows.

[Specific Surface Area (BET Method)]

This was measured according to a nitrogen gas adsorption amount based on DIN 66131.

[pH]

A pH value of a dispersion liquid in which a distilled water is added to a specimen and which was stirred by a homomixer was measured with a glass electrode pH meter.

[Average Primary-Particle Diameter]

This was measured with a transmission electron microscope.

Example 1

Two low-voltage cable cores each coated with an insulator formed of polytetrafluoroethylene and having a 0.25 mm thickness and two high-voltage cable cores each composed of a bare conductor with a 1.25 $mm^2$ sectional area which was formed by collective stranding of 50 tin-plated annealed copper wires each having a 0.18 mm diameter were stranded on a conductor having a 1.8 $mm^2$ sectional area which was formed by collective stranding of 19 tin-plated annealed copper wires each having a 0.35 mm diameter, whereby a cable core part was formed. A semiconductive tape formed of a nylon base material was wound around an outer periphery of the cable core part to form an inner semiconductive layer having a thickness of about 0.5 mm.

An insulating composition, which was prepared by uniformly kneading 100 parts by mass of EPDM (Mitsui EPT #1045, trade name, manufactured by Mitsui Chemicals, Inc.), 0.5 part by mass of dry silica with a 200 $m^2/g$ specific surface area (BET method), a 4.2 pH, and a 12 nm average primary-particle diameter (noted as dry silica (a)), and 2.5 parts by mass of dicumyl peroxide (DCP) by a mixing roll, was applied by extrusion on the inner semiconductive layer, and then was thermally crosslinked to form a high-voltage insulator having a 2.7 mm thickness. A semiconductive tape formed of a nylon base material was further wound on the high-voltage insulator to dispose an outer semiconductive layer having a thickness of about 0.15 mm. A shielding layer formed of a braid of tin-plated annealed copper wires and having a 0.3 mm thickness was provided on the outer semiconductive layer, and on its exterior, a soft vinyl chloride resin sheath was applied by extrusion to produce a cable for high-voltage electronic devices (X-ray cable) having a 13.2 mm outside diameter.

Examples 2, 3, Comparative Examples 1 to 4

Cables for high-voltage electronic devices were produced in the same manner as in the example 1 except that the compositions of forming materials of the high-voltage insulator were changed as shown in Table 1. Dry silicas used besides the dry silica (a) are as follows.

dry silica (b): specific surface area (BET method) 100 $m^2/g$, ph 4.2, average primary-particle diameter 10 nm dry silica (c): specific surface area (BET method) 300 $m^2/g$, ph 4.0, average primary-particle diameter 12 nm Regarding the cables for high-voltage electronic devices obtained in the examples and the comparative examples, capacitance and a withstand voltage characteristic were measured or evaluated by the following methods.

[Capacitance]

This was measured by a high-voltage Schering bridge method under conditions of 1 kV and a 50 Hz frequency.

[Withstand Voltage Characteristic]

A 200 kV DC voltage was applied for ten minutes, and acceptance judgment was made (○) if there occurred no insulation breakdown and rejection judgment was made (×) if there occurred insulation breakdown.

The results are shown in Table 1 together with physical properties (volume resitivity (23° C. and 90° C.), temperature dependence parameter $D_R$, hardness, dielectric constant) of the high-voltage insulator. Methods of measuring the physical properties of the high-voltage insulator are as follows.

[Volume Resistivity, Temperature Dependence Parameter $D_R$]

A sheet specimen having a 0.5 mm thickness was prepared separately from the production of the cable. A 500 V DC voltage was applied to this specimen based on the double ring electrode method specified in JIS K 6271, a current value was measured one minute later, and volume resistivity was found. The volume resistivity at 90° C. was measured after the specimen was kept at the same temperature for five minutes or more so that the whole specimen had uniformly 90° C. The measurement was conducted five times and an average value thereof was found. Further, logarithms log $R_{23°\ C.}$ and log $R_{90°\ C.}$ of the volume resistivities at 23° C. and 90° C. thus found were found, and the temperature dependence parameter $D_R$ was calculated by the aforesaid expression (1).

[Hardness]

A sheet specimen having a 2 mm thickness was prepared separately from the production of the cable, and its hardness was measured by the type A durometer specified by JIS K 6253.

[Dielectric Constant]

A sheet specimen with a 0.5 mm thickness was prepared separately from the production of the cable, and its dielectric constant was measured by the high-voltage Schering bridge method under conditions of 1 kV and a 50 Hz frequency.

TABLE 1

| | | | Example 1 | Example 2 | Example 3 | CE 1 | CE 2 | CE 3 | CE 4 |
|---|---|---|---|---|---|---|---|---|---|
| Composition (part by mass) | EPDM | | 100 | 100 | 100 | 100 | 100 | 100 | 100 |
| | Dry silica (a) | | 0.5 | 5.0 | 10.0 | 0.3 | 20.0 | — | — |
| | Dry silica (b) | | — | — | — | — | — | 5.0 | — |
| | Dry silica (c) | | — | — | — | — | — | — | 5.0 |
| | Crosslinking agent | | 2.5 | 2.5 | 2.5 | 2.5 | 2.5 | 2.5 | 2.5 |
| Physical properties/ Characteristic evaluation | Volume Resistivity (Ω · cm) | 23° C. | $1.1 \times 10^{17}$ | $1.3 \times 10^{17}$ | $9.5 \times 10^{16}$ | $2.0 \times 10^{17}$ | $8.3 \times 10^{15}$ | $1.3 \times 10^{17}$ | $1.5 \times 10^{17}$ |
| | | 90° C. | $1.5 \times 10^{17}$ | $1.9 \times 10^{17}$ | $4.3 \times 10^{16}$ | $4.0 \times 10^{15}$ | $6.8 \times 10^{14}$ | $1.1 \times 10^{16}$ | $1.0 \times 10^{16}$ |
| | Temperature dependence parameter $D_R$ | | −0.1 | −0.2 | 0.3 | 1.7 | 1.1 | 1.1 | 1.2 |
| | Durometer hardness (type A) of high-voltage insulator | | 57 | 60 | 62 | 55 | 70 | 58 | 61 |
| | Dielectric constant of high-voltage insulator | | 2.2 | 2.2 | 2.3 | 2.2 | 3.1 | 2.3 | 2.4 |
| | Capacitance (μF/km) | | 0.183 | 0.185 | 0.187 | 0.183 | 0.250 | 0.188 | 0.190 |
| | Withstand voltage characteristic | | ○ | ○ | ○ | x | x | x | x |

CE1 to CE4 = Comparative Example 1 to Comparative Example 4

As shown in Table 1, even though the cable of the examples in which the high-voltage insulator was formed of the insulating composition compounded with 0.5 to 10 parts by mass of the dry silica whose specific surface area was not less than 150 $m^2/g$ nor more than 250 $m^2/g$ had a small outside diameter of 11.5 mm, they had a good withstand voltage characteristic and capacitance satisfying the required performance of the NEMA Standard (XR7) (the capacitance of the NEMA Standard (XR7) is 0.187 μF/km or less). On the other hand, in the comparative examples 1 to 4 in which the dry silica was compounded in an excessively small amount or in an excessively large amount, the withstand voltage characteristic was insufficient, and the cables using the silica whose specific surface area did not fall within the aforesaid range had an insufficient withstand voltage characteristic regardless of its compounding amount.

In the present invention, the high-voltage insulator is made of the insulating composition that contains a specific ratio of the dry silica relative to the olefin-based polymer, the specific surface area of the dry silica measured by the nitrogen gas adsorption method being not less than 150 $m^2/g$ nor more than 250 $m^2/g$, and accordingly it is possible to obtain a cable for high-voltage electronic devices that has a small diameter, a small capacitance, and sufficient insulation performance.

What is claimed is:

1. A cable for high-voltage electronic devices, comprising:

a cable core part;

an inner semiconductive layer provided on an outer periphery of the cable core part;

a high-voltage insulator provided on an outer periphery of the inner semiconductive layer;

an outer semiconductive layer provided on an outer periphery of the high-voltage insulator;

a shielding layer provided on an outer periphery of the outer semiconductive layer; and a sheath provided on an outer periphery of the shielding layer cable core part, wherein the high-voltage insulator is made of an insulating composition having a temperature dependence parameter $D_R$ defined by the following expression of 1.0 or less:

$$D_R = \log R_{23^\circ C.} - \log R_{90^\circ C.},$$

(where $R_{23^\circ C.}$ is volume resistivity (Ω·cm) at 23° C. and $R_{90^\circ C.}$ is volume resistivity (Ω·cm) at 90° C.), and $R_{23^\circ C.}$ is not less than $1.0\times10^{14}$ Ω·cm nor more than $1.0\times10^{18}$ Ω·cm.

2. The cable according to claim 1, wherein the insulating composition comprises an olefin-based polymer, and dry silica with a specific surface area of not less than 150 $m^2/g$ nor more than 250 $m^2/g$.

3. The cable according to claim 2, wherein the insulating composition comprises 100 parts by mass of the olefin-based polymer and not less than 0.5 part by mass nor more than 10 parts by mass of the dry silica.

4. The cable according to claim 2, wherein an average primary-particle diameter of the dry silica is not less than 7 nm nor more than 20 nm.

5. The cable according to claim 2, wherein pH of a 4% aqueous dispersion liquid of the dry silica is not less than 4 nor more than 4.5.

6. The cable according to claim 2, wherein the dry silica is fumed silica.

7. The cable according to claim 2, wherein the olefin-based polymer comprises ethylene propylene rubber.

8. The cable according to claim 2, wherein the olefin-based polymer is crosslinked.

9. The cable according to claim 1, the cable being a small-diameter cable for high-voltage electronic devices having an outside diameter of not less than 10 mm nor more than 70 mm.

* * * * *